US011795965B2

(12) United States Patent
Fukui et al.

(10) Patent No.: US 11,795,965 B2
(45) Date of Patent: Oct. 24, 2023

(54) AIR-SENDING DEVICE

(71) Applicant: Mitsubishi Electric Corporation, Tokyo (JP)

(72) Inventors: Tomoya Fukui, Tokyo (JP); Toshikatsu Arai, Tokyo (JP); Hitoshi Kikuchi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/917,259

(22) PCT Filed: Apr. 30, 2020

(86) PCT No.: PCT/JP2020/018281

§ 371 (c)(1),
(2) Date: Oct. 6, 2022

(87) PCT Pub. No.: WO2021/220469

PCT Pub. Date: Nov. 4, 2021

(65) Prior Publication Data

US 2023/0122146 A1 Apr. 20, 2023

(51) Int. Cl.
*F04D 29/38* (2006.01)

(52) U.S. Cl.
CPC ..... *F04D 29/386* (2013.01); *F05D 2240/30* (2013.01); *F05D 2260/96* (2013.01)

(58) Field of Classification Search
CPC .... F04D 29/386; F04D 29/164; F04D 29/526; F04D 29/384; F05D 2240/30; F05D 2260/96; F05D 2240/307
See application file for complete search history.

(56) References Cited

U.S. PATENT DOCUMENTS

2014/0246180 A1 9/2014 Nakashima et al.
2018/0335055 A1* 11/2018 Goto ..... F04D 29/687

FOREIGN PATENT DOCUMENTS

JP 3629702 B2 3/2005
JP 2010-236371 A 10/2010
JP 2012-233420 A 11/2012
JP 2018-193876 A 12/2018

OTHER PUBLICATIONS

International Search Report and Written Opinion dated Jul. 7, 2020, received for PCT Application PCT/JP2020/018281, filed on Apr. 30, 2020, 9 pages including English Translation.
Extended European Search Report dated May 30, 2023, in corresponding European Patent Application No. 20933470.5, 7pp.

* cited by examiner

*Primary Examiner* — Brandon D Lee
(74) *Attorney, Agent, or Firm* — XSENSUS LLP

(57) ABSTRACT

An air-sending device includes a propeller fan to rotate about a rotational axis, and a ducted bell mouth surrounding an outboard area of the propeller fan. The propeller fan includes a plurality of blades. Each of the blades includes, in its outboard portion, a reflexed part bent upstream of an airflow that is generated in the direction of the rotational axis by rotation of the propeller fan. In the propeller fan, within an area that is closer to the trailing edge than is the near mid-chord area, the propeller fan is inclined downstream of the airflow from the inboard edge to the reflexed part. In at least a portion of an area where the cylindrical part of the bell mouth and the outboard edge of each blade face each, the reflexed part has a reflex angle of greater than or equal to 90 degrees.

7 Claims, 9 Drawing Sheets

AIR-SENDING DEVICE

CROSS-REFERENCE TO RELATED APPLICATION

The present application is based on PCT filing PCT/JP2020/018281, filed Apr. 30, 2020, the entire contents of which is incorporated herein by reference.

TECHNICAL FIELD

The present disclosure relates to an air-sending device including a propeller fan, and a bell mouth surrounding an outboard area of the propeller fan.

BACKGROUND ART

Some proposed air-sending devices in the related art include a propeller fan, and a bell mouth surrounding an outboard area of the propeller fan. Such air-sending devices are used for applications such as ventilators and air-conditioners. Rotation of the propeller fan causes a leakage flow to occur near the outboard edge of each blade of the propeller fan, whereby air flows from the pressure surface toward the suction surface. The leakage flow gives rise to a blade tip vortex near the suction surface. Accordingly, some proposed air-sending devices in the related art including a propeller fan and a bell mouth are designed such that, to mitigate noise resulting from such a blade tip vortex, the outboard part of each blade of the propeller fan is bent toward the suction side to form a bent part, with the bent part gradually increasing in width in the radial direction from the leading edge to the trailing edge (see Patent Literature 1). The radial direction refers to a direction perpendicular to the rotational axis of the propeller fan. The above-mentioned bent part of each blade of the propeller fan described in Patent Literature 1 will be hereinafter referred to as reflexed part.

CITATION LIST

Patent Literature

Patent Literature 1: Japanese Patent No. 3629702

SUMMARY OF INVENTION

Technical Problem

Exemplary bell mouths include semi-open bell mouths and ducted bell mouths. In the case of a semi-open bell mouth, the bell mouth faces a region of the outboard edge of each blade of the propeller fan, the region extending from the middle of the outboard edge to the trailing edge of the blade. By contrast, in the case of a ducted bell mouth, the bell mouth faces most of the outboard edge of each blade of the propeller fan. For example, in the case of a ducted bell mouth, when the ducted bell mouth and each blade are observed in a direction perpendicular to the rotational axis of the propeller fan, greater than or equal to 90% of the outboard edge of the blade faces the bell mouth. The air-sending device described in Patent Literature 1 is an air-sending device with a semi-open bell mouth.

A bell mouth includes a contraction part that gradually decreases in diameter in the direction of flow of an airflow generated by rotation of the propeller fan, and a cylindrical part through which an airflow guided by the contraction part flows. In the case of an air-sending device with a ducted bell mouth, the cylindrical part of the bell mouth, and the outboard edge of each blade face each other over a wide region in comparison to an air-sending device with a semi-open bell mouth. Due to the above-mentioned difference in bell mouth shape, an air-sending device with a ducted bell mouth, and an air-sending device with a semi-open bell mouth greatly differ in how air flows in the vicinity of the outboard edge of each blade of the propeller fan. This means that using the propeller fan used for the air-sending device described in Patent Literature 1, which is an air-sending device with a semi-open bell mouth, in combination with a ducted bell mouth fails to sufficiently mitigate noise caused by blade tip vortex.

Specifically, in a region where the cylindrical part of the bell mouth and the outboard edge of the blade face each other, the cylindrical part and the outboard edge are at a short distance from each other. Consequently, in the region where the cylindrical part of the bell mouth and the outboard edge of the blade face each other, a blade tip vortex is generated as air flows from the pressure surface of the blade toward the suction surface. The generated blade tip vortex interferes with the cylindrical part of the bell mouth. As a result, in the region where the cylindrical part of the bell mouth and the outboard edge of the blade face each other, the flow of air in the vicinity of the outboard edge of the blade becomes turbulent. This leads to increased pressure fluctuations and consequently increased noise. The larger the region where the cylindrical part of the bell mouth and the outboard edge of the blade face each other, the greater the noise mentioned above. Consequently, the noise is greater for an air-sending device with a ducted bell mouth than for an air-sending device with a semi-open bell mouth. In this regard, for the air-sending device described in Patent Literature 1, a blade shape capable of noise mitigation has been contemplated based on the assumption of using a combination of a semi-open bell mouth and a propeller fan. This means that using a ducted bell mouth in combination with the propeller fan of the air-sending device described in Patent Literature 1 fails to sufficiently mitigate noise caused by blade tip vortex. That is, related-art air-sending devices with a ducted bell mouth are still inadequate in mitigating noise caused by blade tip vortex.

The present disclosure is directed to addressing the problem mentioned above. Accordingly, it is an object of the present disclosure to provide an air-sending device including a ducted bell mouth and capable of reducing noise caused by blade tip vortex in comparison to the related art.

Solution to Problem

An air-sending device according to an embodiment of the present disclosure includes a propeller fan configured to rotate about a rotational axis, and a bell mouth surrounding an outboard area of the propeller fan. The propeller fan includes a boss, and a plurality of blades projecting from the boss in a direction outboard of the boss. Each of the plurality of blades includes a reflexed part in its outboard portion, the reflexed part being bent upstream of an airflow, the airflow being generated in a direction of the rotational axis in response to rotation of the propeller fan. The bell mouth includes a contraction part and a cylindrical part, the contraction part gradually decreasing in diameter in a direction of the airflow, the cylindrical part being a part of the bell mouth through which the airflow flows after being guided by the contraction part. When the bell mouth and each of the plurality of blades are observed in a direction perpendicular to the rotational axis, greater than or equal to 90% of an outboard edge of the blade faces the bell mouth. In each of the plurality of blades, the following features are defined: a circle of a given radius centered on the rotational axis is defined as an imaginary circle; a cross-section of the blade taken along a plane passing through the imaginary circle and parallel to the rotational axis is defined as a first cross-section; a given point on a chord line in the first cross-section is defined as an imaginary point; a value obtained by dividing a distance in the first cross-section from the imaginary point to a leading edge of the blade, by a distance in the first cross-section from the imaginary point to a trailing edge of the blade is defined as a position ratio; a line formed by connecting, while varying a radius of the imaginary circle, points that are identical to each other in the position ratio is defined as an imaginary line; a cross-section of the blade taken along a plane passing through the imaginary line and parallel to the rotational axis is defined as a second cross-section; a view of the second cross-section as projected onto a plane passing through the rotational axis is defined as a projection view; in the projection view, an intersection point between a pressure surface of the blade and the boss is defined as an inboard point; in the projection view, an inflection point of the reflexed part on the pressure surface is defined as a reflex point; in the projection view, a straight line passing through the inboard point and perpendicular to the rotational axis is defined as a first straight line; in the projection view, a straight line passing through the inboard point and a given point on the pressure surface is defined as a second straight line; in the projection view, a tangent passing through an outboard end of the blade is defined as a third straight line; of angles formed by the first straight line and the second straight line, an acute angle diverging outboard of the propeller fan is defined as a blade inclination angle; a direction in which the blade inclination angle diverges upstream of the airflow relative to the first straight line is defined as a positive direction of the blade inclination angle; a direction in which the blade inclination angle diverges downstream of the airflow relative to the first straight line is defined as a negative direction of the blade inclination angle; the blade inclination angle formed when the second straight line passes through the reflex point is defined as a first blade inclination angle; and, of angles formed by the second straight line and the third straight line, an angle diverging outboard of the propeller fan and upstream of the airflow is defined as a reflex angle. With these features defined as described above, within an area where the position ratio is greater than or equal to at least 1, the first blade inclination angle has a negative value, and in at least a portion of an area where the cylindrical part of the bell mouth and the outboard edge of the blade face each other in the direction perpendicular to the rotational axis, the reflex angle is greater than or equal to 90 degrees.

Advantageous Effects of Invention

The air-sending device according to an embodiment of the present disclosure includes a so-called ducted bell mouth. In the air-sending device according to an embodiment of the present disclosure, within its area where the position ratio is greater than or equal to at least 1, the first blade inclination angle has a negative value. This helps to reduce the length of each blade of the propeller fan in the direction of the rotational axis. As a result, in the direction of the rotational axis, the region where the cylindrical part of the bell mouth and the outboard edge of each blade face each other can be reduced. Further, in the air-sending device according to an embodiment of the present disclosure, in at least a portion of the area where the cylindrical part of the bell mouth and the outboard edge of each blade face each other in a direction perpendicular to the rotational axis, the reflex angle is greater than or equal to 90 degrees. This helps to ensure that in at least a portion of the area where the cylindrical part of the bell mouth and the outboard edge of each blade face each other in the direction perpendicular to the rotational axis, when a blade tip vortex generated by flow of air from the pressure surface of the blade toward the suction surface interferes with the cylindrical part of the bell mouth, turbulence that occurs in the flow of air in the vicinity of the outboard edge can be mitigated. This makes it possible to mitigate pressure fluctuations in the vicinity of the outboard edge. Therefore, the air-sending device according to an embodiment of the present disclosure is capable of, when implemented as an air-sending device including a ducted bell mouth, reducing noise caused by blade tip vortex in comparison to the related art.

DESCRIPTION OF EMBODIMENTS

Embodiment 1

Figure 1:
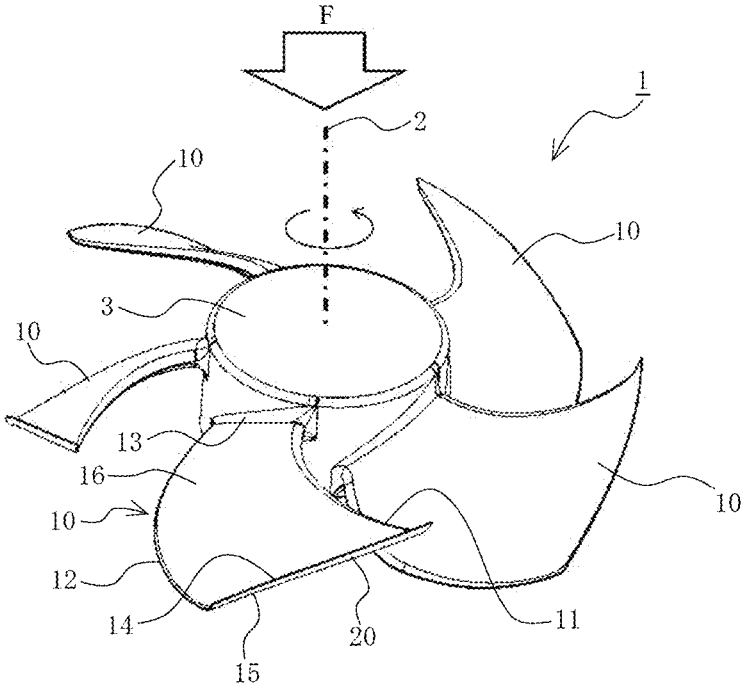
FIG. 1 is a perspective view of a propeller fan of an air-sending device according to Embodiment 1.

FIG. 1 is a perspective view of a propeller fan of an air-sending device according to Embodiment 1. An air-sending device 100 according to Embodiment 1 includes a bell mouth 50 in addition to a propeller fan 1 illustrated in FIG. 1. The bell mouth 50 will be described later.

The propeller fan 1 is configured to rotate about a rotational axis 2 in a direction represented by an arcuate arrow in FIG. 1. The propeller fan 1 includes a boss 3 about which the propeller fan 1 rotates, and a plurality of blades 10 projecting from the boss 3 in a direction outboard of the boss 3. For example, the blades 10 extend radially from the boss 3 in a substantially radial configuration. The radial direction refers to a direction perpendicular to the rotational axis 2.

Each of the blades 10 includes a leading edge 11, a trailing edge 12, an inboard edge 13, an outboard edge 14, a pressure surface 15, and a suction surface 16. The leading edge 11 is the edge at the leading part of the blade 10 in the direction of rotation of the blade 10. The trailing edge 12 is the edge at the trailing part of the blade 10 in the direction of rotation of the blade 10. The inboard edge 13 is the edge at the inboard part of the blade 10 and where the blade 10 is connected with the boss 3. The outboard edge 14 is the radially outboard end of the blade 10. The pressure surface 15 is a surface of the blade 10 that pushes out air. In FIG. 1, the lower surface of the blade 10 in FIG. 1 corresponds to the pressure surface 15. The suction surface 16 is a surface of the blade 10 that is opposite from the pressure surface 15. In FIG. 1, the upper surface of the blade 10 in FIG. 1 corresponds to the suction surface 16.

When the propeller fan 1 rotates by means of a motor (not illustrated), an airflow F is generated in the direction of the rotational axis 2 as represented by an open arrow in FIG. 1. Hereinafter, an area located upstream of the airflow F will be sometimes referred to simply as upstream. Further, an area located downstream of the airflow F will be sometimes referred to simply as downstream. The motor (not illustrated) is disposed, for example, inside the boss 3. However, the motor may not necessarily be disposed inside the boss 3 but may be disposed in other locations such as downstream from the boss 3.

Each of the blades 10 of the propeller fan 1 according to Embodiment 1 includes, in its outboard portion, a reflexed part 20 that is bent upstream. That is, in FIG. 1, the reflexed part 20 is reflexed further upward with increasing radial distance from the boss 3.

Although the propeller fan 1 is depicted in FIG. 1 as having five blades 10, the propeller fan 1 may not necessarily have five blades 10. Hereinafter, a single blade 10 will be sometimes described with reference to the illustration of the blade 10. However, it is to be noted that other blades 10 are also identical in configuration to the illustrated blade 10.

Figure 2:
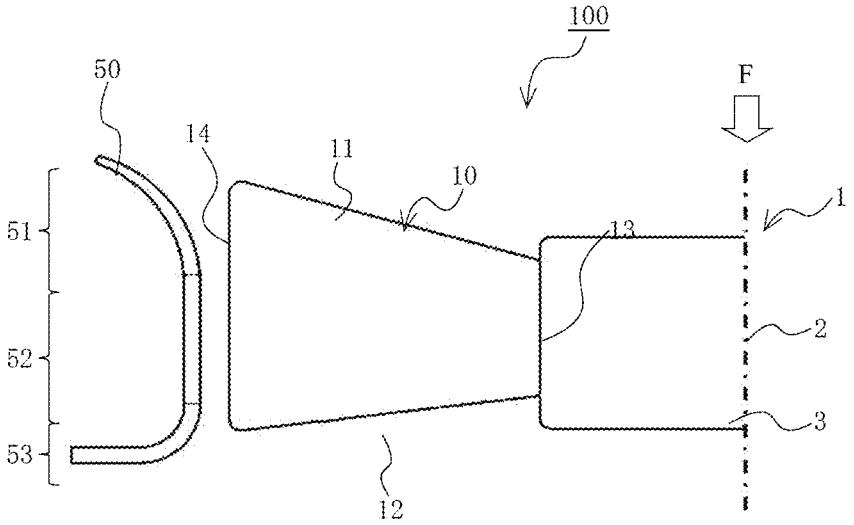
FIG. 2 illustrates the air-sending device according to Embodiment 1.
Figure 3:
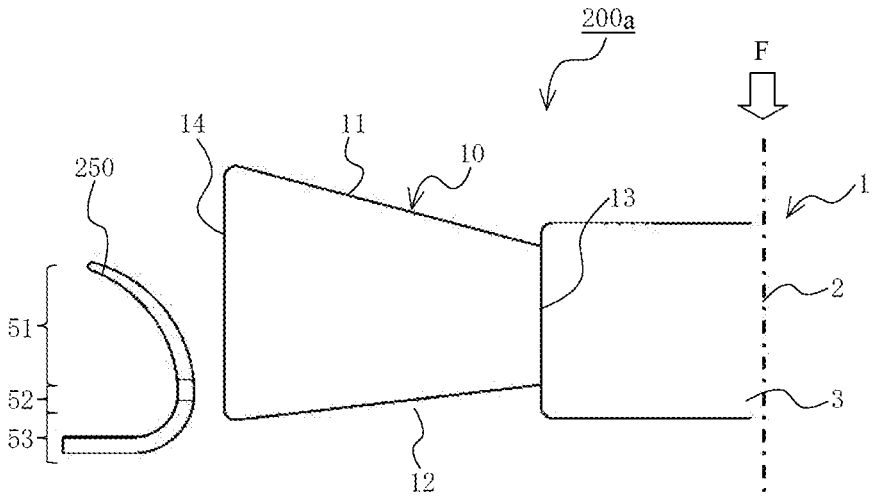
FIG. 3 Related Art
FIG. 3 illustrates an air-sending device according to Comparative Example 1.

FIG. 2 illustrates the air-sending device according to Embodiment 1. FIG. 2 illustrates the propeller fan 1 and the bell mouth 50 of the air-sending device 100 according to Embodiment 1 that are rotated and projected onto a plane passing through the rotational axis 2 and parallel to the rotational axis 2. FIG. 3 illustrates an air-sending device according to Comparative Example 1. FIG. 3 illustrates an air-sending device 200*a* according to Comparative Example 1, which is an air-sending device including a combination of the propeller fan 1 according to Embodiment 1 and a bell mouth 250 according to Comparative Example 1. FIG. 3 illustrates the propeller fan 1 and the bell mouth 250 according to Comparative Example 1 that are rotated and projected onto a plane passing through the rotational axis 2 and parallel to the rotational axis 2. In FIG. 3, features of the bell mouth 250 according to Comparative Example 1 that are identical in function to those of the bell mouth 50 according to Embodiment 1 are designated by the same reference signs as those used for the bell mouth 50 according to Embodiment 1.

The bell mouth 50 according to Embodiment 1, and the bell mouth 250 according to Comparative Example 1 each surround an outboard area of the propeller fan 1. The bell mouth 50 according to Embodiment 1, and the bell mouth 250 according to Comparative Example 1 each include a contraction part 51 that gradually decreases in diameter in the direction of the airflow F, and a cylindrical part 52 through which the airflow F flows after being guided by the contraction part 51. That is, the cylindrical part 52 is disposed downstream from the contraction part 51. The cylindrical part 52 is equal in diameter to the smallest-diameter portion of the contraction part 51. The cylindrical part 52 does not change in diameter. This means that for the bell mouth 50 according to Embodiment 1 and the bell mouth 250 according to Comparative Example 1, the cylindrical part 52 represents a portion of the bell mouth located at a short distance to the outboard edge 14 of the blade 10. The bell mouth 50 according to Embodiment 1, and the bell mouth 250 according to Comparative Example 1 each also include an expansion part 53 located downstream from the cylindrical part 52 and having a diameter that gradually increases in the direction of the airflow F. The airflow F exits through the expansion part 53.

Exemplary related-art bell mouths include semi-open bell mouths, and ducted bell mouths. In the case of a semi-open bell mouth, the bell mouth faces a region of the outboard edge of each blade of the propeller fan, the region extending from the middle of the outboard edge to the trailing edge of the blade. By contrast, in the case of a ducted bell mouth, the bell mouth faces most of the outboard edge of each blade of the propeller fan. For example, when the ducted bell mouth and each blade are observed in a direction perpendicular to the rotational axis of the propeller fan, greater than or equal to 90% of the outboard edge of the blade faces the bell mouth.

That is, the bell mouth 250 according to Comparative Example 1 illustrated in FIG. 3 is a semi-open bell mouth. The bell mouth 50 according to Embodiment 1 illustrated in FIG. 2 is a ducted bell mouth. That is, the air-sending device 100 according to Embodiment 1 is an air-sending device including a combination of the bell mouth 50, which is a ducted bell mouth, and the propeller fan 1. The bell mouth 50 may be shaped such that, as viewed in a cross-section passing through the rotational axis 2 and parallel to the rotational axis 2, the contraction part 51 has a large curvature radius. Further, the cylindrical part 52 may be formed to have a large length. Increasing the curvature radius of the contraction part 51, however, increases the size of the air-sending device 100 in the radial direction. Accordingly, the contraction part 51 according to Embodiment 1 is formed in the shape of an elliptic curve such that as viewed in a cross-section passing through the rotational axis 2 and parallel to the rotational axis 2, the contraction part 51 has a small curvature radius at or near the inlet, with the curvature radius increasing progressively toward the cylindrical part 52.

Detailed reference is now made to the configuration of each blade 10 of the propeller fan 1. In describing the configuration of the blade 10 in detail, an imaginary circle R, a first cross-section 30, an imaginary point 31, a position ratio P, an imaginary line SL, and a second cross-section 40 are defined as illustrated in FIG. 4.

Figure 4:
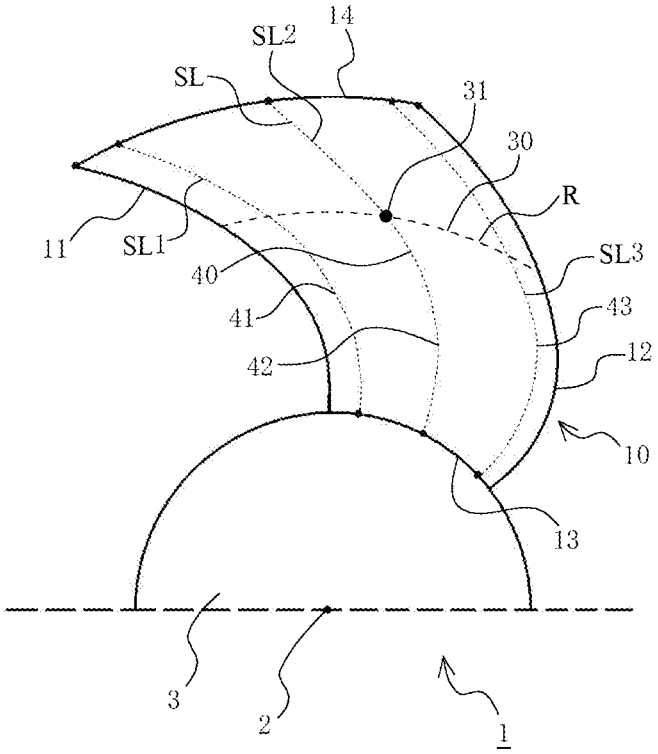
FIG. 4 illustrates the propeller fan of the air-sending device according to Embodiment 1 as projected onto a plane orthogonal to the rotational axis of the propeller fan.

FIG. 4 illustrates the propeller fan of the air-sending device according to Embodiment 1 as projected onto a plane orthogonal to the rotational axis of the propeller fan. FIG. 3 depicts only one blade 10.

As illustrated in FIG. 4, a circle of a given radius centered on the rotational axis 2 of the propeller fan 1 is defined as the imaginary circle R. A cross-section of the blade 10 taken along a plane passing through the imaginary circle R and parallel to the rotational axis 2 is defined as the first cross-section 30. A given point on a chord line in the first cross-section 30 is defined as the imaginary point 31. A value obtained by dividing the distance in the first cross-section 30 from the imaginary point 31 to the leading edge 11 of the blade 10, by the distance in the first cross-section 30 from the imaginary point 31 to the trailing edge 12 of the blade 10 is defined as the position ratio P. A line formed by connecting points with the same position ratio P while varying the radius of the imaginary circle R is defined as the imaginary line SL. A cross-section of the blade 10 taken along a plane passing through the imaginary line SL and parallel to the rotational axis 2 is defined as the second cross-section 40.

FIG. 4 depicts the following exemplary imaginary lines SL: an imaginary line SL1, an imaginary line SL2, and an imaginary line SL3. The imaginary line SL1 is the imaginary line SL near the leading edge 11, and is the imaginary line SL located where the position ratio P is 0.2. The imaginary line SL2 is the imaginary line SL obtained by connecting the midpoints between the leading edge 11 and the trailing edge 12 in the first cross-section 30, and is the imaginary line SL located where the position ratio P is 1. The imaginary line SL3 is the imaginary line SL near the trailing edge 12, and is the imaginary line SL located where the position ratio P is 7.5. Hereinafter, the second cross-section 40 taken along the imaginary line SL1 is defined as a second cross-section 41. The second cross-section 40 taken along the imaginary line SL2 is defined as a second cross-section 42. The second cross-section 40 taken along the imaginary line SL3 is defined as a second cross-section 43.

Figure 5:
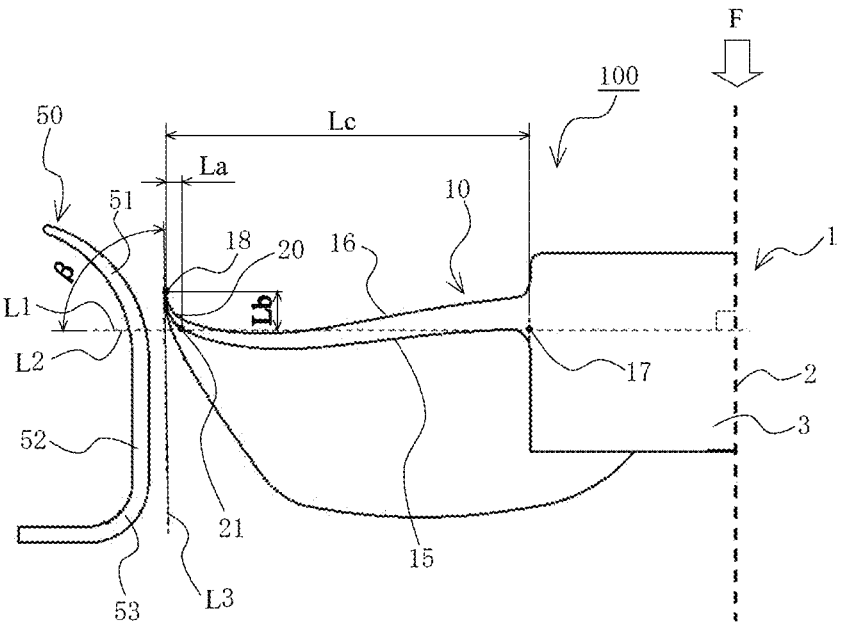
FIG. 5 illustrates a second cross-section 41 of a blade of the propeller fan according to Embodiment 1 as projected onto a plane passing through the rotational axis of the propeller fan.
Figure 6:
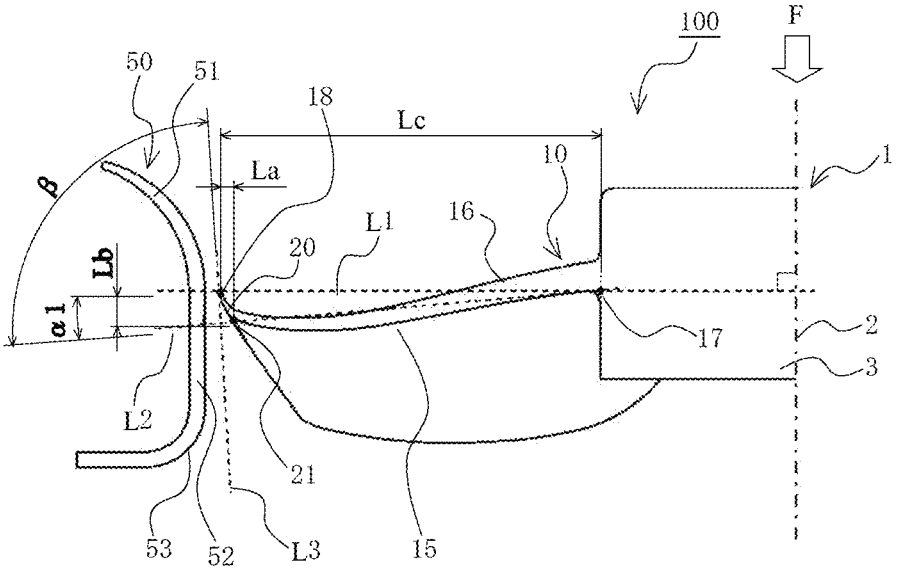
FIG. 6 illustrates a second cross-section 42 of a blade of the propeller fan according to Embodiment 1 as projected onto a plane passing through the rotational axis of the propeller fan.
Figure 7:
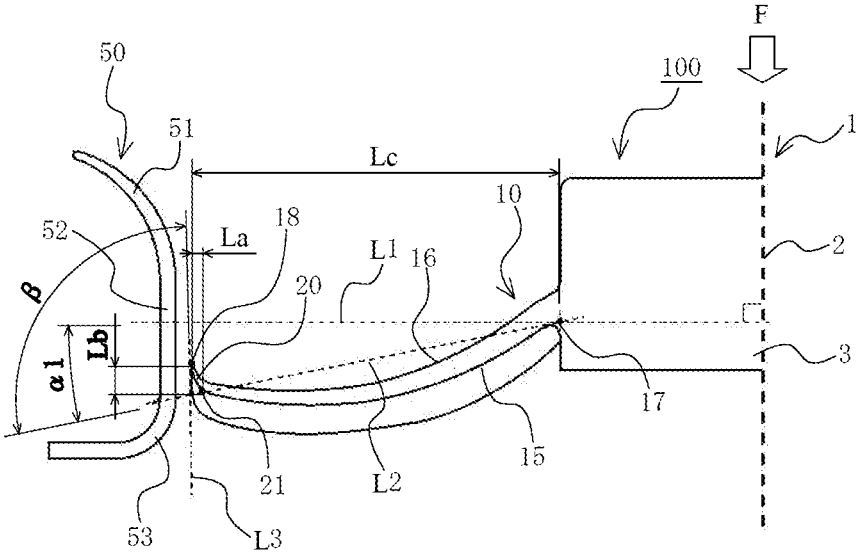
FIG. 7 illustrates a second cross-section 43 of a blade of the propeller fan according to Embodiment 1 as projected onto a plane passing through the rotational axis of the propeller fan.

FIG. 5 illustrates the second cross-section 41 of a blade of the propeller fan according to Embodiment 1 as projected onto a plane passing through the rotational axis of the propeller fan. FIG. 6 illustrates the second cross-section 42 of a blade of the propeller fan according to Embodiment 1 as projected onto a plane passing through the rotational axis of the propeller fan. FIG. 7 illustrates the second cross-section 43 of a blade of the propeller fan according to Embodiment 1 as projected onto a plane passing through the rotational axis of the propeller fan. In FIGS. 5 to 7, the boss 3 of the propeller fan 1, and the bell mouth 50 are both projected onto a plane passing through the rotational axis 2.

Reference is now made to FIGS. 5 to 7 to describe the configuration of each blade 10 of the propeller fan 1 in detail. A leakage flow near the outboard edge 14, which is the cause of blade tip vortex, arises when air flows near the outboard edge 14 from the pressure surface 15 toward the suction surface 16. The leakage flow occurs along the shape of the pressure surface 15. Accordingly, in the following description, the configuration of each blade 10 of the propeller fan 1 is described with the pressure surface 15 taken as a reference.

As illustrated in FIGS. 5 to 7, an inboard point 17, a reflex point 21, a first straight line L1, a second straight line L2, a third straight line L3, a blade inclination angle $\alpha$, a first blade inclination angle $\alpha$1, and a reflex angle $\beta$ are defined.

Specifically, in the projection views of FIGS. 5 to 7, the intersection point between the pressure surface 15 of the blade 10 and the boss 3 is defined as the inboard point 17. In the projection views of FIGS. 5 to 7, the inflection point of the reflexed part 20 on the pressure surface 15 is defined as the reflex point 21. In the projection views of FIGS. 5 to 7, a straight line passing through the inboard point 17 and perpendicular to the rotational axis 2 is defined as the first straight line L1. In the projection views of FIGS. 5 to 7, a straight line passing through the inboard point 17 and a given point on the pressure surface 15 is defined as the second straight line L2. The reflex point 21 represents an example of a given point on the pressure surface 15. In the projection views of FIGS. 5 to 7, a tangent passing through an outboard end 18 of the blade 10 is defined as the third straight line L3. The outboard end 18 represents a point on the outboard edge 14.

Of the angles formed by the first straight line L1 and the second straight line L2, an acute angle diverging outboard of the propeller fan 1 is defined as the blade inclination angle $\alpha$. The blade inclination angle $\alpha$ formed when the second straight line L2 passes through the reflex point 21 is defined as the first blade inclination angle $\alpha$1. FIG. 5 depicts, as an example of the second straight line L2, the second straight line L2 that passes through the reflex point 21. In this case, in FIG. 5, the first straight line L1 and the second straight line L2 overlap each other. Thus, the blade inclination angle $\alpha$ is not depicted in FIG. 5. FIGS. 6 and 7 each likewise depict, as an example of the second straight line L2, the second straight line L2 that passes through the reflex point 21. Thus, FIGS. 6 and 7 each depict the first blade inclination angle $\alpha$1 as an example of the blade inclination angle $\alpha$. Of the angles formed by the second straight line L2 and the third straight line L3, an angle diverging outboard of the propeller fan 1 and upstream of the airflow F is defined as the reflex angle $\beta$. The positive and negative directions of the blade inclination angle $\alpha$ are defined as described below. The direction in which the blade inclination angle $\alpha$ diverges upstream of the airflow F relative to the first straight line L1 is defined as the positive direction of the blade inclination angle $\alpha$. The direction in which the blade inclination angle $\alpha$ diverges downstream of the airflow F relative to the first straight line L1 is defined as the negative direction of the blade inclination angle $\alpha$. That is, in FIGS. 5 to 7, if the blade inclination angle $\alpha$ diverges toward the lower part in FIG. 1 relative to the first straight line L1, the blade inclination angle $\alpha$ has a negative value.

As illustrated in FIGS. 5 to 7, in each blade 10 of the propeller fan 1 according to Embodiment 1, within an area where the position ratio P is greater than or equal to at least 1, the first blade inclination angle $\alpha$1 has a negative value. In other words, in each blade 10 of the propeller fan 1 according to Embodiment 1, within an area located closer to the trailing edge 12 than is the midpoint between the leading edge 11 and the trailing edge 12, the first blade inclination angle α1 has a negative value. In still other words, in each blade 10 of the propeller fan 1 according to Embodiment 1, within an area where the position ratio P is greater than or equal to at least 1, the reflex point 21 is located further downstream of the airflow F than is the first straight line L1. In the blade 10 of the propeller fan 1 illustrated in FIGS. 5 to 7, an area of the blade 10 that extends from a location near the leading edge 11 where the position ratio P is 0.2 to the trailing edge 12, the first blade inclination angle α1 has a negative value.

The above-mentioned configuration of the propeller fan 1 helps to reduce the length of the blade 10 of the propeller fan 1 in the direction of the rotational axis 2. As a result, in the direction of the rotational axis 2, the region where the cylindrical part 52 of the bell mouth 50 and the outboard edge 14 of the blade 10 face each other can be reduced. In this regard, in the case of an air-sending device with a ducted bell mouth, in a region where the cylindrical part of the bell mouth and the outboard edge of the blade face each other, the cylindrical part and the outboard edge are at a short distance from each other. This means that for a related-art air-sending device with a ducted bell mouth, in a region where the cylindrical part of the bell mouth and the outboard edge of the blade face each other, a blade tip vortex generated due to flow of air from the pressure surface of the blade toward the suction surface interferes with the cylindrical part of the bell mouth. As a result, in the region where the cylindrical part of the bell mouth and the outboard edge of the blade face each other, the flow of air in the vicinity of the outboard edge of the blade becomes turbulent. This leads to increased pressure fluctuations and consequently increased noise. By contrast, the air-sending device 100 according to Embodiment 1 makes it possible to reduce the region where the cylindrical part 52 of the bell mouth 50 and the outboard edge 14 of the blade 10 face each other, that is, reduce the region where noise increases. This helps to reduce noise caused by blade tip vortex.

As illustrated in FIGS. 5 to 7, in the blade 10 of the propeller fan 1 according to Embodiment 1, the reflex angle β is greater than or equal to 90 degrees in at least a portion of the area where the cylindrical part 52 of the bell mouth 50 and the outboard edge 14 of the blade 10 face each other in a direction perpendicular to the rotational axis 2. In the blade 10 of the propeller fan 1 illustrated in FIGS. 5 to 7, the reflex angle β is greater than or equal to 90 degrees in the entire area where the cylindrical part 52 of the bell mouth 50 and the outboard edge 14 of the blade 10 face each other in a direction perpendicular to the rotational axis 2. The above-mentioned configuration makes it possible for an air-sending device with a ducted bell mouth to further reduce noise caused by blade tip vortex. The reason for this is described below in detail with reference to FIGS. 8 to 10.

Figure 8:
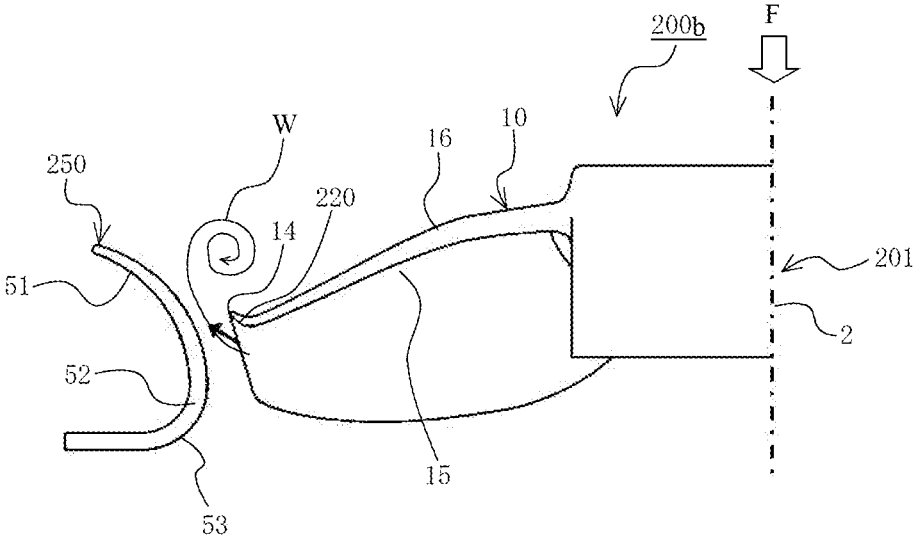
FIG. 8 Related Art
FIG. 8 illustrates flow of air in the vicinity of the outboard edge of a blade of an air-sending device according to Comparative Example 2.
Figure 9:
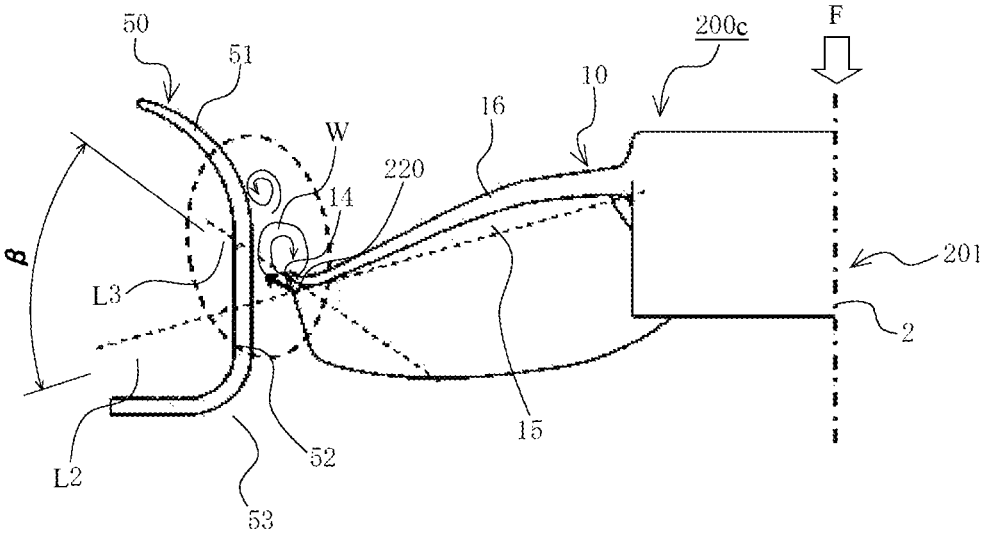
FIG. 9 Related Art
FIG. 9 illustrates flow of air in the vicinity of the outboard edge of a blade of an air-sending device according to Comparative Example 3.
Figure 10:
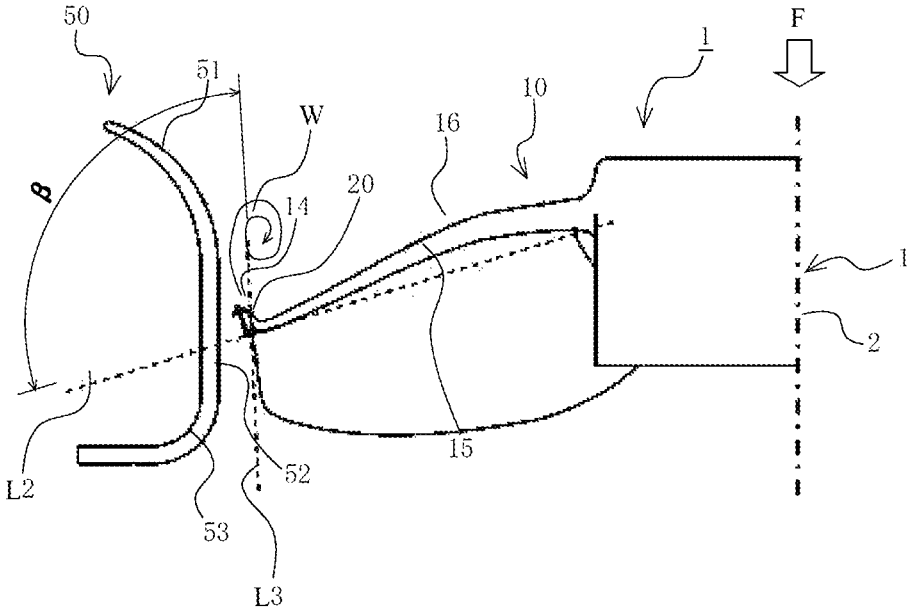
FIG. 10 illustrates flow of air in the vicinity of the outboard edge of a blade of the air-sending device according to Embodiment 1.

FIG. 8 illustrates flow of air in the vicinity of the outboard edge of a blade of an air-sending device according to Comparative Example 2. FIG. 9 illustrates flow of air in the vicinity of the outboard edge of a blade of an air-sending device according to Comparative Example 3. FIG. 10 illustrates flow of air in the vicinity of the outboard edge of a blade of the air-sending device according to Embodiment 1.

An air-sending device 200*b* according to Comparative Example 2, and an air-sending device 200*c* according to Comparative Example 3 each include a propeller fan 201. In FIGS. 8 and 9, features of the propeller fan 201 that are identical in function to those of the propeller fan 1 according to Embodiment 1 are designated by the same reference signs as those used for the bell mouth 50 according to Embodiment 1. The propeller fan 201 differs from the propeller fan 1 according to Embodiment 1 in the reflex angle β of the propeller fan 201. The reflex angle β of the propeller fan 201 is less than 90 degrees. As with the propeller fan 201, related-art propeller fans also have a reflex angle β of less than 90 degrees. That is, the propeller fan 201 includes a reflexed part 220 with a related-art reflex angle commonly used in the art.

The air-sending device 200*b* according to Comparative Example 2 is an air-sending device including a combination of the propeller fan 201, and the bell mouth 250 described above with reference to the air-sending device 200*a* according to Comparative Example 1. That is, the air-sending device 200*b* according to Comparative Example 2 is an air-sending device with a semi-open bell mouth. The air-sending device 200*c* according to Comparative Example 3 is an air-sending device including a combination of the propeller fan 201, and the bell mouth 50 according to Embodiment 1. That is, the air-sending device 200*c* according to Comparative Example 3 is an air-sending device with a ducted bell mouth.

As illustrated in FIG. 8, if the bell mouth 250, which is a semi-open bell mouth, and the propeller fan 201 having the reflexed part 220 with a commonly used reflex angle are used in combination, the presence of the reflexed part 220 stabilizes a blade tip vortex W generated by a leakage flow that arises due to flow of air from the pressure surface 15 toward the suction surface 16 of the blade 10. In this case, the bell mouth 250 and the outboard edge 14 of the blade 10 have a relatively large distance from each other. This helps to mitigate pressure fluctuations in the vicinity of the blade 10, and consequently reduce noise.

However, as illustrated in FIG. 9, if the bell mouth 50 that is a ducted bell mouth, and the propeller fan 201 having the reflexed part 220 with a commonly used reflex angle are used in combination, the cylindrical part 52 of the bell mouth 50 is present in proximity to the outboard edge 14 of the blade 10. Consequently, within the area represented by a dotted line in FIG. 9, the blade tip vortex W interferes with the cylindrical part 52 of the bell mouth 50. This creates large turbulence in the flow of air in the vicinity of the outboard edge 14 of the blade 10. Due to the large turbulence that occurs in the flow of air in the vicinity of the outboard edge 14 of the blade 10, the wall surface of the bell mouth 50 is also subjected to large pressure fluctuations. This may cause increased noise.

As with the air-sending device 200*c* according to Comparative Example 3 illustrated in FIG. 9, the air-sending device 100 according to Embodiment 1 includes the bell mouth 50 that is a ducted bell mouth. However, for the propeller fan 1 of the air-sending device 100 according to Embodiment 1, in at least a portion of the area where the cylindrical part 52 of the bell mouth 50 and the outboard edge 14 of the blade 10 face each other in a direction perpendicular to the rotational axis 2, the reflex angle β is greater than or equal to 90 degrees. This configuration helps to ensure that as illustrated in FIG. 10, within the area where the reflex angle β is greater than or equal to 90 degrees, the leakage flow has a large component that is directed upstream of the airflow F, and a small component that is directed toward the cylindrical part 52 of the bell mouth 50, in comparison to the case where the reflex angle β is less than 90 degrees. Further, the cylindrical part 52 of the bell mouth 50 and the outboard edge 14 of the blade 10 can be positioned at an increased distance from each other. This makes it possible for the air-sending device 100 according to Embodiment 1 to mitigate interference of the blade tip vortex W with the cylindrical part 52 of the bell mouth 50, and consequently mitigate turbulence that occurs in the flow of air in the vicinity of the outboard edge 14 of the blade 10. Therefore, the air-sending device 100 according to Embodiment 1 makes it possible to mitigate fluctuations of the pressure on the wall surface of the bell mouth 50, and consequently reduce noise.

The region of strong flow varies with the shape of the blade 10. Accordingly, the area with the reflex angle β greater than or equal to 90 degrees is preferably positioned in the region of strong leakage flow. Further, it is preferable to increase the reflex angle β with increasing strength of the leakage flow. In the air-sending device 100 according to Embodiment 1, most of the outboard edge 14 of the blade 10 faces the cylindrical part 52 and the expansion part 53 of the bell mouth 50 in a direction perpendicular to the rotational axis 2. Accordingly, in Embodiment 1, the leakage flow at the outboard edge 14 of the blade 10 is strong in a region that is closer to the trailing edge 12 than is the near mid-chord region. Therefore, according to Embodiment 1, it is preferred that the reflex angle β be greater than or equal to 90 degrees in a region that is closer to the trailing edge 12 than is the near mid-chord region.

The reflexed part 20 illustrated in FIGS. 5 to 7 has a reflex width La that is preferably dimensioned as described below. Specifically, in the projection views of FIGS. 5 to 7, the length between the reflex point 21 and the outboard end 18 in the direction perpendicular to the rotational axis 2 is defined as the reflex width La. The length between the inboard point 17 and the outboard end 18 in the direction perpendicular to the rotational axis 2 is defined as a blade width Lc. In this case, the reflex width La is preferably less than or equal to 10% of the blade width Lc. This is due to an observation that an excessively large reflex width La tends to result in reduced air-sending capacity of the propeller fan 1.

The reflexed part 20 illustrated in FIGS. 5 to 7 has a reflex height Lb that is preferably dimensioned as described below. Specifically, in the projection views of FIGS. 5 to 7, the length between the reflex point 21 and the outboard end 18 in the direction of the rotational axis 2 is defined as the reflex height Lb. In this case, the reflex height Lb is preferably less than or equal to 10% of the blade width Lc. This is due to an observation that an excessively large reflex height Lb tends to result in noise level degradation.

Lastly, the results of examination made to examine the noise mitigation effect of the air-sending device 100 according to Embodiment 1 are presented below.

Figure 11:
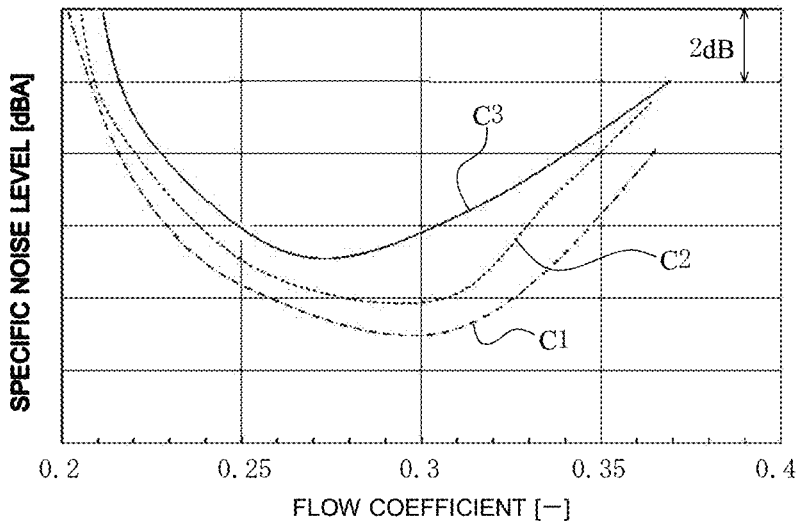
FIG. 11 illustrates an examination of the relationship between the reflexed part of a blade of a propeller fan, and noise.

FIG. 11 illustrates an examination of the relationship between the reflexed part of a blade of a propeller fan, and noise. The horizontal axis in FIG. 11 represents flow coefficient. The vertical axis in FIG. 11 represents specific noise level. A curve C1 in FIG. 11 represents the examination results on the air-sending device 100 according to Embodiment 1. A curve C2 in FIG. 11 represents the examination results on the air-sending device 200*c* according to Comparative Example 3. That is, the curve C2 in FIG. 11 represents the examination results on an air-sending device that combines the bell mouth 50 according to Embodiment 1 with the propeller fan 201 including the reflexed part 220 having a reflex angle commonly used in the art. A curve C3 in FIG. 11 represents the examination results on an air-sending device that combines the bell mouth 50 according to Embodiment 1 with a propeller fan having no reflexed part. The propeller fan corresponding to the curve C3 is similar in configuration to the propeller fan 1 according to Embodiment 1 except for the absence of the reflexed part.

As illustrated in FIG. 11, the propeller fan 201 with the reflexed part 220 provided improved noise mitigation in comparison to the propeller fan with no reflexed part. However, as can be observed, for example, in the region with a flow coefficient in the vicinity of 0.35, at high airflow operating points with relatively large flow coefficient, the propeller fan 201 with the reflexed part 220 provided hardly any noise mitigation effect in comparison to the propeller fan with no reflexed part. That is, for the propeller fan 201 with no area where the reflex angle β is 90 degrees, hardly any noise mitigation effect was observed at high airflow operating points with relatively large flow coefficient. By contrast, the propeller fan 1 according to Embodiment 1 including the reflexed part 20 was observed to provide improved noise reduction across the operating range from low airflow operating points with relatively small flow coefficient to high airflow operating points with relatively large flow coefficient, in comparison to the propeller fan 201 with the reflexed part 220 and the propeller fan with no reflexed part.

Figure 12:
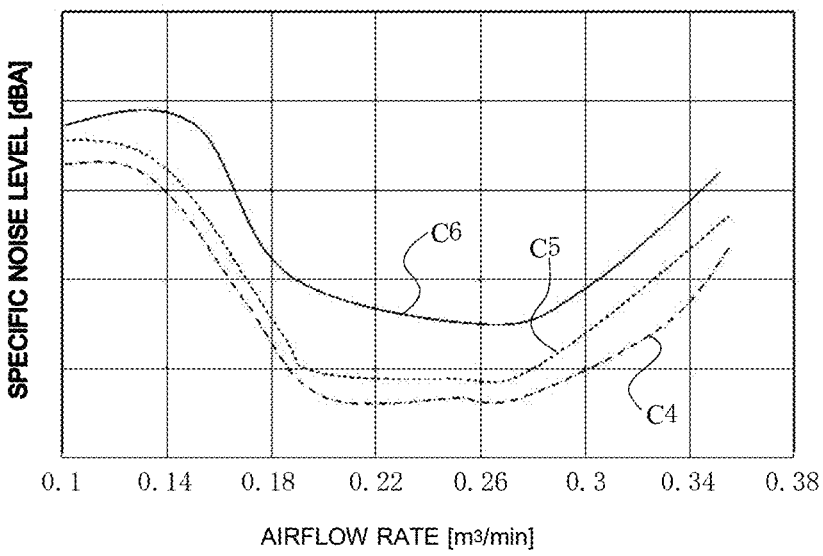
FIG. 12 illustrates an examination of the relationship between the reflex height of the reflexed part of a blade, and noise.

FIG. 12 illustrates an examination of the relationship between the reflex height of the reflexed part of a blade, and noise. The horizontal axis in FIG. 12 represents the airflow rate of the air-sending device. The vertical axis in FIG. 12 represents specific noise level. A curve C4 in FIG. 12 represents the examination results on the air-sending device 100 of the propeller fan 1 according to Embodiment 1, with the reflex height Lb set to less than or equal to 10% of the blade width Lc. A curve C5 in FIG. 12 represents the examination results on the air-sending device 100 of the propeller fan 1 according to Embodiment 1, with the reflex height Lb set to greater than 10% of the blade width Lc. A curve C6 in FIG. 12 represents the examination results on an air-sending device that combines the bell mouth 50 according to Embodiment 1 with a propeller fan having no reflexed part. The propeller fan corresponding to the curve C6 is similar in configuration to the propeller fan 1 according to Embodiment 1 except for the absence of the reflexed part.

As illustrated in FIG. 12, the propeller fan 1 with the reflexed part 20 provided improved noise mitigation in comparison to the propeller fan with no reflexed part. Further, setting the reflex height Lb to less than or equal to 10% of the blade width Lc was observed to provide further improved noise mitigation.

As described above, the air-sending device 100 according to Embodiment 1 includes the propeller fan 1 configured to rotate about the rotational axis 2, and the bell mouth 50 surrounding an outboard area of the propeller fan 1. The propeller fan 1 includes the boss 3, and the blades 10 projecting from the boss 3 in a direction outboard of the boss 3. Each of the blades 10 includes the reflexed part 20 in its outboard portion, the reflexed part being bent upstream of the airflow F that is generated in the direction of the rotational axis 2 in response to rotation of the propeller fan 1. The bell mouth 50 includes the contraction part 51 that gradually decreases in diameter in the direction of the airflow F, and the cylindrical part 52 through which the airflow F flows after being guided by the contraction part 51. When the bell mouth 50 and each of the blades 10 are observed in a direction perpendicular to the rotational axis 2, greater than or equal to 90% of the outboard edge 14 of the blade 10 faces the bell mouth 50. In each of the blades 10, a circle of a given radius centered on the rotational axis 2 of the propeller fan 1 is defined as the imaginary circle R. A cross-section of the blade 10 taken along a plane passing through the imaginary circle R and parallel to the rotational axis 2 is defined as the first cross-section 30. A given point on a chord line in the first cross-section 30 is defined as the imaginary point 31. A value obtained by dividing the distance in the first cross-section 30 from the imaginary point 31 to the leading edge 11 of the blade 10, by the distance in the first cross-section 30 from the imaginary point 31 to the trailing edge 12 of the blade 10 is defined as the position ratio P. A line formed by connecting, while varying the radius of the imaginary circle R, points that are identical to each other in the position ratio P is defined as the imaginary line SL. A cross-section of the blade 10 taken along a plane passing through the imaginary line SL and parallel to the rotational axis 2 is defined as the second cross-section 40. A view of the second cross-section 40 as projected onto a plane passing through the rotational axis 2 is defined as a projection view. In the projection view, the intersection point between the pressure surface 15 of the blade 10 and the boss 3 is defined as the inboard point 17. In the projection view, an inflection point of the reflexed part 20 on the pressure surface 15 is defined as the reflex point 21. In the projection view, a straight line passing through the inboard point 17 and perpendicular to the rotational axis 2 is defined as the first straight line L1. In the projection view, a straight line passing through the inboard point 17 and a given point on the pressure surface 15 is defined as the second straight line L2. In the projection view, a tangent passing through the outboard end 18 of the blade 10 is defined as the third straight line L3. Of the angles formed by the first straight line L1 and the second straight line L2, an acute angle diverging outboard of the propeller fan 1 is defined as the blade inclination angle α. The direction in which the blade inclination angle α diverges upstream of the airflow F relative to the first straight line L1 is defined as the positive direction of the blade inclination angle α. The direction in which the blade inclination angle α diverges downstream of the airflow F relative to the first straight line L1 is defined as the negative direction of the blade inclination angle α. The blade inclination angle α formed when the second straight line L2 passes through the reflex point 21 is defined as the first blade inclination angle α1. Of the angles formed by the second straight line L2 and the third straight line L3, an angle diverging outboard of the propeller fan 1 and upstream of the airflow F is defined as the reflex angle β. With the first blade inclination angle α1 and the reflex angle β being defined as described above, in the air-sending device 100 according to Embodiment 1, within an area where the position ratio P is greater than or equal to at least 1, the first blade inclination angle α1 has a negative value. Further, in the air-sending device 100 according to Embodiment 1, in at least a portion of the area where the cylindrical part 52 of the bell mouth 50 and the outboard edge 14 of the blade 10 face each other in the direction perpendicular to the rotational axis 2, the reflex angle β is greater than or equal to 90 degrees.

In the air-sending device 100 according to Embodiment 1, within the area where the position ratio P is greater than or equal to at least 1, the first blade inclination angle α1 has a negative value. This makes it possible for the air-sending device 100 according to Embodiment 1 to reduce the length of each blade 10 of the propeller fan 1 in the direction of the rotational axis 2, and reduce noise caused by blade tip vortex as described above. Further, in the air-sending device 100 according to Embodiment 1, in at least a portion of the area where the cylindrical part 52 of the bell mouth 50 and the outboard edge 14 of the blade 10 face each other in a direction perpendicular to the rotational axis 2, the reflex angle β is greater than or equal to 90 degrees. This helps to further reduce noise caused by blade tip vortex. Therefore, the air-sending device 100 according to Embodiment 1 is capable of, when implemented as an air-sending device including a ducted bell mouth, reducing noise caused by blade tip vortex in comparison to the related art.

Embodiment 2

Shaping each blade 10 of the propeller fan 1 as described below makes it possible to further reduce noise caused by blade tip vortex. In the following description of Embodiment 2, matters not particularly mentioned are assumed to be similar to those described above with reference to Embodiment 1, and functions and features identical to those of Embodiment 1 are designated by the same reference signs as those used for Embodiment 1.

Figure 13:
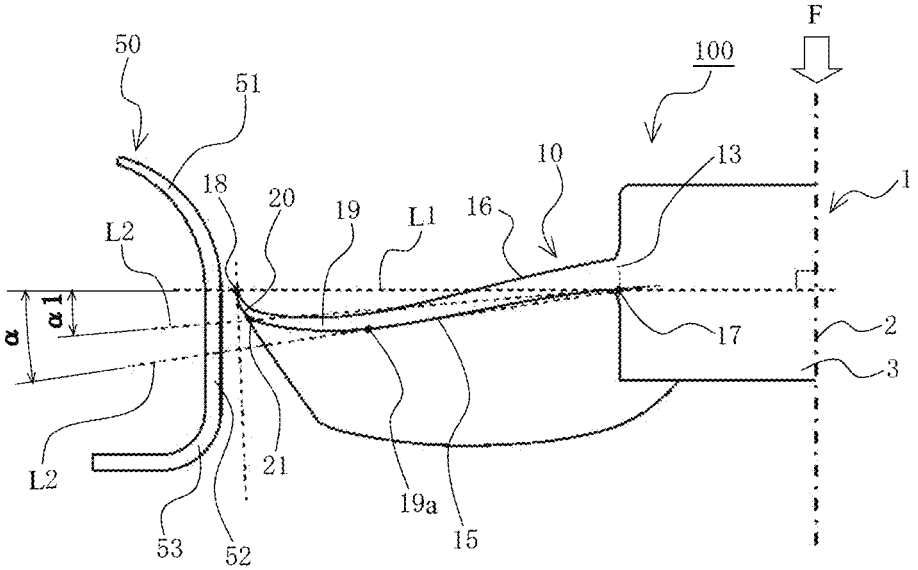
FIG. 13 illustrates the second cross-section 41 of a blade of a propeller fan according to Embodiment 2 as projected onto a plane passing through the rotational axis of the propeller fan.

FIG. 13 illustrates a second cross-section of a blade of a propeller fan according to Embodiment 2 as projected onto a plane passing through the rotational axis of the propeller fan. FIG. 13 depicts two second straight lines L2. The first one of the two second straight lines L2 is the second straight line L2 that passes through the reflex point 21. The second one of the two straight lines L2 is the second straight line L2 that passes through a reflex point 19*a*. The reflex point 19*a* is an inflection point, on the pressure surface 15, of an intermediate inflection part 19 described later.

Each of the blades 10 of the propeller fan 1 according to Embodiment 2 includes the intermediate inflection part 19 between the inboard edge 13 and the reflexed part 20. In a projection view obtained by projecting the second cross-section 40 onto a plane passing through the rotational axis 2, when the blade 10 is viewed from the inboard point 17 in a direction outboard of the propeller fan 1, the blade 10 is bent in the intermediate inflection part 19 toward the suction surface 16. Due to the above-mentioned configuration of each blade 10, air flowing radially outward along the pressure surface 15 is deflected in the intermediate inflection part 19 so as to be directed upstream of the airflow F, before being guided to the reflexed part 20. Consequently, due to the above-mentioned configuration of each blade 10, the air flowing radially outward along the pressure surface 15 can be smoothly guided to reach the outboard end 18. Therefore, the above-mentioned configuration of each blade 10 helps to further mitigate fluctuations of the pressure on the wall surface of the bell mouth 50, and consequently reduce noise caused by blade tip vortex.

In the projection view obtained by projecting the second cross-section 40 onto a plane passing through the rotational axis 2, the amount by which the blade inclination angle α changes due to a movement by a unit length from the inboard point 17 in a direction outboard of the propeller fan 1 along the pressure surface 15 is defined as a rate of change in the blade inclination angle α. With the rate of change in the blade inclination angle α being defined as described above, the rate of change between the inboard point 17 and the intermediate inflection part 19 is less than the rate of change between the intermediate inflection part 19 and the reflex point 21 of the reflexed part 20. Further, the rate of change between the intermediate inflection part 19 and the reflex point 21 of the reflexed part 20 is less than the rate of change between the reflex point 21 of the reflexed part 20 and the outboard end 18. Due to the above-mentioned configuration of each blade 10, air flowing radially outward along the pressure surface 15 can be gradually deflected so as to be directed upstream of the airflow F. Consequently, the above-mentioned configuration of each blade 10 helps to further ensure that air flowing radially outward along the pressure surface 15 can be smoothly guided to reach the outboard end 18. Therefore, the above-mentioned configuration of each blade 10 helps to further mitigate fluctuations of the pressure on the wall surface of the bell mouth 50, and consequently further reduce noise caused by blade tip vortex.

Embodiment 3

In the foregoing description of Embodiment 1 and Embodiment 2, no particular mention has been made to chordwise variation of the reflex height Lb of the reflexed part 20. The reflex height Lb of the reflexed part 20 may be varied chordwise as described below with reference to Embodiment 3. In the following description of Embodiment 3, matters not particularly mentioned are assumed to be similar to those described above with reference to Embodiment 1 or Embodiment 2, and functions and features identical to those of Embodiment 1 or Embodiment 2 are designated by the same reference signs as those used for Embodiment 1 or Embodiment 2.

Figure 14:
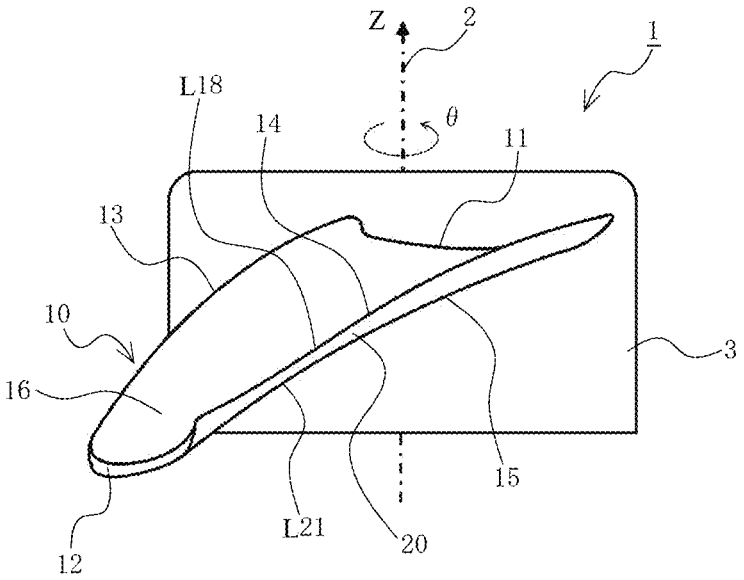
FIG. 14 illustrates a propeller fan according to Embodiment 3 as viewed in a direction perpendicular to the rotational axis of the propeller fan.
Figure 15:
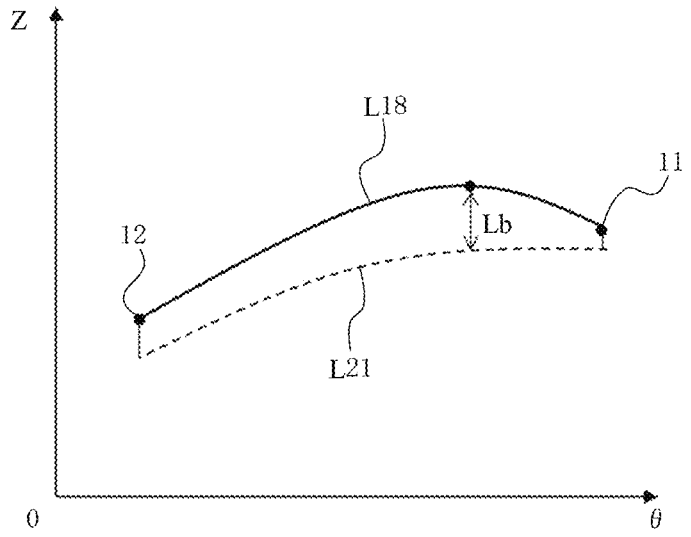
FIG. 15 illustrates chordwise variation of the reflex height of a reflexed part in the propeller fan according to Embodiment 3.

FIG. 14 illustrates a propeller fan according to Embodiment 3 as viewed in a direction perpendicular to the rotational axis of the propeller fan. FIG. 15 illustrates chordwise variation of the reflex height of a reflexed part in the propeller fan according to Embodiment 3. It is to be noted that FIG. 14 depicts only one of the blades 10 of the propeller fan 1.

As illustrated in FIG. 14, a line formed by connecting the outboard ends 18 while varying the position ratio P is defined as a curve L18. That is, the curve L18 defines the outboard edge 14 of the blade 10. Further, as illustrated in FIG. 14, a line formed by connecting the reflex points 21 of the reflexed part 20 while varying the position ratio P is defined as a curve L21. FIG. 15 illustrates the curve L18 and the curve L21 that are developed in a rotational direction θ illustrated in FIG. 14. The vertical axis Z in FIG. 15 represents the direction of the rotational axis 2. That is, FIG. 15 is obtained by plotting the positions of the outboard end 18 and the reflex point 21 while varying the position ratio P. As for the curve L18 and the curve L21 that are depicted in FIG. 15, the right-hand side in FIG. 15 represents a location near the leading edge 11, and the left-hand side in FIG. 15 represents a location near the trailing edge 12.

With regard to a blade tip vortex generated near the outboard edge 14 of each blade 10 of the propeller fan 1, the location where the blade tip vortex occurs and the path taken by the blade tip vortex vary greatly between when the propeller fan 1 operates at a relatively high airflow rate and when the propeller fan 1 operates at a relatively low airflow rate. When the propeller fan 1 operates at a relatively high airflow rate, the blade tip vortex occurring near the outboard edge 14 of each blade 10 is strong in a region of the blade 10 that is closer to the leading edge 11 than is the near mid-chord region. Accordingly, if the propeller fan 1 operates often at a relatively high airflow rate, it is preferable that, as with Embodiment 3, the location at which the reflex height Lb has a maximum value be positioned in a region that is closer to the leading edge 11 than is the near mid-chord region. In other words, if the propeller fan 1 operates often at a relatively high airflow rate, each blade 10 preferably has a location of the maximum reflex height Lb that is positioned within an area where the position ratio P is less than 1. The above-mentioned configuration of the blade 10 helps to ensure that when the propeller fan 1 operates at a relatively high airflow rate, in a region where a strong blade tip vortex occurs at this time due to a leakage flow, a component of the leakage flow that is directed toward the cylindrical part 52 of the bell mouth 50 can be further reduced. This helps to further mitigate fluctuations of the pressure on the wall surface of the bell mouth 50. Therefore, the above-mentioned configuration of the blade 10 leads to an improved noise mitigation effect when the propeller fan 1 operates at a relatively high airflow rate.

For reference, the results of examination made to examine the noise mitigation effect of the air-sending device 100 according to Embodiment 3 are presented below.

Figure 16:
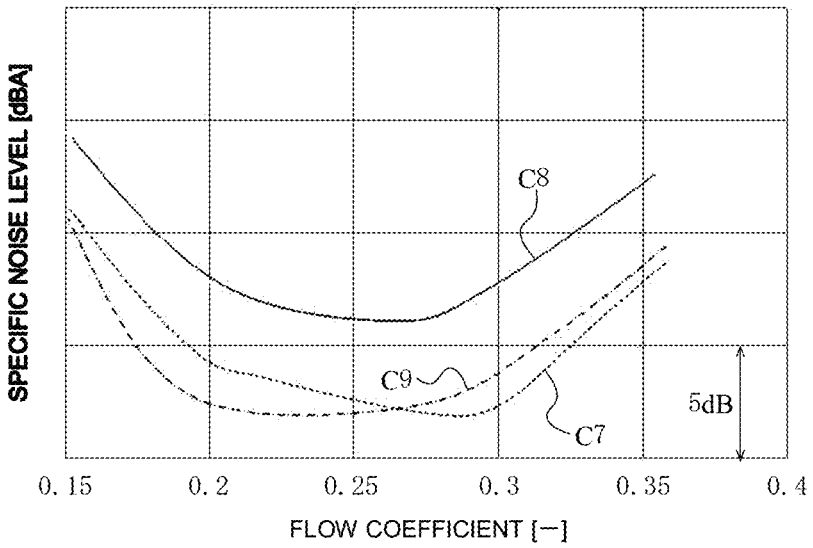
FIG. 16 illustrates an examination of the noise mitigation effect of the air-sending device according to Embodiment 3.

FIG. 16 illustrates an examination of the noise mitigation effect of the air-sending device according to Embodiment 3. The horizontal axis in FIG. 16 represents flow coefficient. The vertical axis in FIG. 16 represents specific noise level. A curve C7 in FIG. 16 represents the examination results on the air-sending device 100 according to Embodiment 3. A curve C8 in FIG. 16 represents the examination results on an air-sending device that combines the bell mouth 50 according to Embodiment 3 with a propeller fan having no reflexed part. The propeller fan corresponding to the curve C8 is similar in configuration to the propeller fan 1 according to Embodiment 1 except for the absence of the reflexed part.

As illustrated in FIG. 16, in comparison to the air-sending device including the propeller fan with no reflexed part, the air-sending device 100 according to Embodiment 3 provided improved noise mitigation across the operating range from low airflow operating points with relatively small flow coefficient to high airflow operating points with relatively large flow coefficient. Further, as can be observed, for example, in the region with a flow coefficient in the vicinity of 0.3, in comparison to the air-sending device including the propeller fan with no reflexed part, the air-sending device 100 according to Embodiment 3 provided particularly improved noise mitigation effect at high airflow operating points with relatively large flow coefficient.

Embodiment 4

The reflex height Lb of the reflexed part 20 may be varied chordwise as described below with reference to Embodiment 4. In the following description of Embodiment 4, matters not particularly mentioned are assumed to be similar to those described above with reference to any one of Embodiments 1 to 3, and functions and features identical to those of any one of Embodiments 1 to 3 are designated by the same reference signs as those used for the one of Embodiments 1 to 3.

Figure 17:
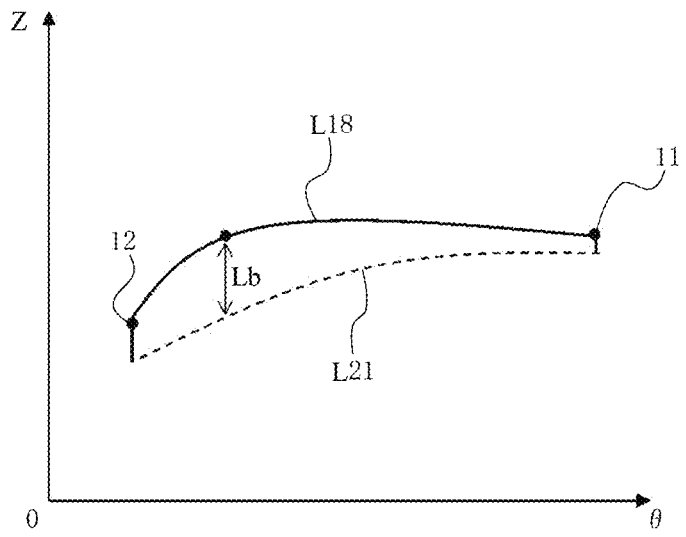
FIG. 17 illustrates chordwise variation of the reflex height of a reflexed part in a propeller fan according to Embodiment 4.

FIG. 17 illustrates chordwise variation of the reflex height of a reflexed part in a propeller fan according to Embodiment 4. FIG. 17 illustrates, for each blade 10 of the propeller fan 1 according to Embodiment 4, the curve L18 and the curve L21 that are developed in the same manner as those in FIG. 15 described above with reference to Embodiment 3.

When the propeller fan 1 operates at a relatively low airflow rate, the blade tip vortex occurring near the outboard edge 14 of each blade 10 is strong in a region of the blade 10 that is located closer to the trailing edge 12 than is the near mid-chord region. Accordingly, if the propeller fan 1 operates often at a relatively low airflow rate, it is preferable that, as with Embodiment 4, the location at which the reflex height Lb has a maximum value be positioned in a region that is closer to the trailing edge 12 than is the near mid-chord region. However, positioning the location of the maximum reflex height Lb at the trailing edge 12 can cause a deterioration of the air-sending performance of the air-sending device 100 if the propeller fan 1 used is one that characteristically undergoes an increase in pressure at the outboard region of the trailing edge 12. For this reason, if the propeller fan 1 operates often at a relatively low airflow rate, the location of the maximum reflex height Lb is preferably positioned at a location that is closer to the trailing edge 12 than is the near mid-chord region, and that is not at the trailing edge 12. That is, the reflexed part 20 of the blade 10 according to Embodiment 4 is shaped such that in a region of the reflexed part 20 located closer to the trailing edge 12 than is the near mid-chord region, the reflexed part 20 is, for example, convex upstream of the airflow F. In other words, if the propeller fan 1 operates often at a relatively low airflow rate, each blade 10 preferably has a location at which the maximum reflex height Lb has a maximum value, the location being within an area where the position ratio P is greater than 1 and being not at the trailing edge 12.

The above-mentioned configuration of the blade 10 helps to ensure that when the propeller fan 1 operates at a relatively low airflow rate, in a region where a strong blade tip vortex occurs at this time due to a leakage flow, a component of the leakage flow that is directed toward the cylindrical part 52 of the bell mouth 50 can be further reduced. This helps to further mitigate fluctuations of the pressure on the wall surface of the bell mouth 50. Therefore, the above-mentioned configuration of the blade 10 leads to an improved noise mitigation effect when the propeller fan 1 operates at a relatively low airflow rate.

For reference, the results of examination made to examine the noise mitigation effect of the air-sending device 100 according to Embodiment 3 are presented below.

In FIG. 16 mentioned above with reference to Embodiment 3, the examination results on the air-sending device 100 according to Embodiment 4 are also represented as a curve C9. As illustrated in FIG. 16, in comparison to the air-sending device including the propeller fan with no reflexed part, the air-sending device 100 according to Embodiment 4 provided improved noise mitigation across the operating range from low airflow operating points with relatively small flow coefficient to high airflow operating points with relatively large flow coefficient. Further, as can be observed, for example, in the region with a flow coefficient in the vicinity of 0.2, in comparison to the air-sending device including the propeller fan with no reflexed part, the air-sending device 100 according to Embodiment 4 provided particularly improved noise mitigation effect at low airflow operating points with relatively small flow coefficient.

Embodiment 5

The reflex height Lb of the reflexed part 20 may be varied chordwise as described below with reference to Embodiment 5. In the following description of Embodiment 5, matters not particularly mentioned are assumed to be similar to those described above with reference to any one of Embodiments 1 to 4, and functions and features identical to those of any one of Embodiments 1 to 4 are designated by the same reference signs as those used for the one of Embodiments 1 to 4.

Figure 18:
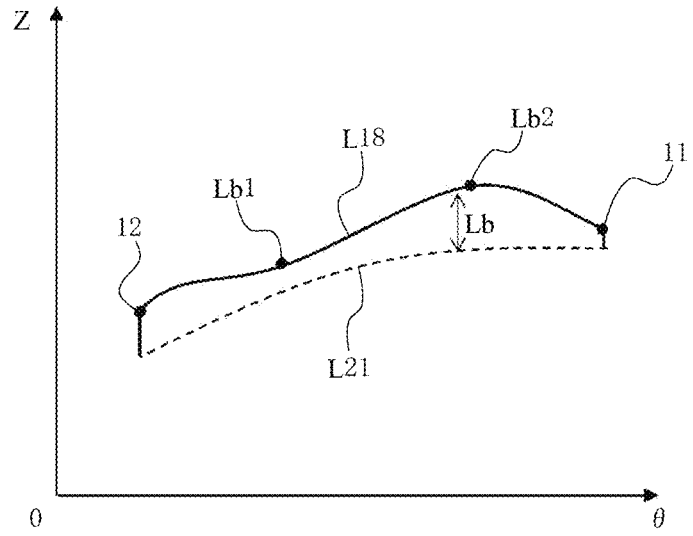
FIG. 18 illustrates chordwise variation of the reflex height of a reflexed part in a propeller fan according to Embodiment 5.

FIG. 18 illustrates chordwise variation of the reflex height of a reflexed part in a propeller fan according to Embodiment 5. FIG. 18 illustrates, for each blade 10 of the propeller fan 1 according to Embodiment 5, the curve L18 and the curve L21 that are developed in the same manner as those in FIG. 15 described above with reference to Embodiment 3.

As described above with reference to Embodiment 3 and Embodiment 4, varying the location of the maximum reflex height Lb makes it possible to effectively mitigate noise in accordance with the airflow rate of the propeller fan 1. Accordingly, if, for example, the propeller fan 1 operates often at a plurality of operating points corresponding to different airflow rates, then as illustrated in FIG. 18, a plurality of locations of increased reflex height Lb may be provided between the leading edge 11 and the trailing edge 12. In such a case, each blade 10 has, between the leading edge 11 and the trailing edge 12, a plurality of locations at each of which the reflex height Lb has an extremal value. In the example illustrated in FIG. 18, each blade 10 has, as extremal values of the reflex height Lb, a single minimal value Lb1, and a single maximal value Lb2.

The above-mentioned configuration of each blade 10 leads to an improved noise mitigation effect when the propeller fan 1 operates at a plurality of operating points corresponding to different airflow rates.

REFERENCE SIGNS LIST

1: propeller fan, 2: rotational axis, 3: boss, 10: blade, 11: leading edge, 12: trailing edge, 13: inboard edge, 14: outboard edge, 15: pressure surface, 16: suction surface, 17: inboard point, 18: outboard end, 19: intermediate inflection part, 19*a*: reflex point, 20: reflexed part, 21: reflex point, 30: first cross-section, 31: imaginary point, 40 (41, 42, 43): second cross-section, 50: bell mouth, 51: contraction part, 52: cylindrical part, 53: expansion part, 100: air-sending device, 200*a*, 200*b*, 200*c*: air-sending device (comparative example), 201: propeller fan (comparative example), 220: reflexed part (comparative example), 250: bell mouth (comparative example), F: airflow, L1: first straight line, L2: second straight line, L3: third straight line, L18: curve, L21: curve, La: reflex width, Lb: reflex height, Lb1: minimal value, Lb2: maximal value, Lc: blade width, P: position ratio, R: imaginary circle, SL (SL1, SL2, SL3): imaginary line, W: blade tip vortex, α: blade inclination angle, α1: first blade inclination angle, β: reflex angle.

The invention claimed is:

1. An air-sending device comprising:

a propeller fan to rotate about a rotational axis; and a bell mouth surrounding an outboard area of the propeller fan, wherein the propeller fan includes a boss, and a plurality of blades projecting from the boss in a direction outboard of the boss, each of the plurality of blades includes a reflexed part in its outboard portion, the reflexed part being bent upstream of an airflow, the airflow being generated in a direction of the rotational axis in response to rotation of the propeller fan, the bell mouth includes a contraction part and a cylindrical part, the contraction part gradually decreasing in diameter in a direction of the airflow, the cylindrical part being a part of the bell mouth through which the airflow flows after being guided by the contraction part, when the bell mouth and each of the plurality of blades are observed in a direction perpendicular to the rotational axis, greater than or equal to 90% of an outboard edge of the blade faces the bell mouth, in each of the plurality of blades, when a circle of a given radius centered on the rotational axis is defined as an imaginary circle, a cross-section of the blade taken along a plane passing through the imaginary circle and parallel to the rotational axis is defined as a first cross-section, a given point on a chord line in the first cross-section is defined as an imaginary point, a value obtained by dividing a distance in the first cross-section from the imaginary point to a leading edge of the blade, by a distance in the first cross-section from the imaginary point to a trailing edge of the blade is defined as a position ratio, a line formed by connecting, while varying a radius of the imaginary circle, points that are identical to each other in the position ratio is defined as an imaginary line, a cross-section of the blade taken along a plane passing through the imaginary line and parallel to the rotational axis is defined as a second cross-section, a view of the second cross-section as projected onto a plane passing through the rotational axis is defined as a projection view, in the projection view, an intersection point between a pressure surface of the blade and the boss is defined as an inboard point, in the projection view, a straight line passing through the inboard point and perpendicular to the rotational axis is defined as a first straight line, in the projection view, a straight line passing through the inboard point and a given point on the pressure surface is defined as a second straight line, in the projection view, a tangent passing through an outboard end of the blade is defined as a third straight line, of angles formed by the first straight line and the second straight line, an acute angle diverging outboard of the propeller fan is defined as a blade inclination angle, a direction in which the blade inclination angle diverges upstream of the airflow relative to the first straight line is defined as a positive direction of the blade inclination angle, a direction in which the blade inclination angle diverges downstream of the airflow relative to the first straight line is defined as a negative direction of the blade inclination angle, in the projection view, the blade has, on the pressure surface of the reflexed part, a reflex point as a point where the blade is bent so as to be reflexed toward upstream as the blade is spaced from the boss in a radial direction and the blade inclination angle formed when the second straight line passes through the reflex point is defined as a first blade inclination angle, within an area where the position ratio is greater than or equal to at least 1, the first blade inclination angle has a negative value, and of angles formed by the second straight line and the third straight line, an angle diverging outboard of the propeller fan and upstream of the airflow is defined as a reflex angle, in at least a portion of an area where the cylindrical part of the bell mouth and the outboard edge of the blade face each other in the direction perpendicular to the rotational axis, the reflex angle is greater than or equal to 90 degrees, each of the plurality of blades includes an intermediate inflection part, the intermediate inflection part being located between an inboard edge of the blade and the reflexed part, and in the projection view, when each of the plurality of blades is viewed from the inboard point in the direction outboard of the propeller fan, the blade is bent in the intermediate inflection part toward a suction surface of the blade.

2. The air-sending device of claim 1, wherein in the projection view, when an amount by which the blade inclination angle changes due to a movement by a unit length from the inboard point in the direction outboard of the propeller fan along the pressure surface is defined as a rate of change in the blade inclination angle, the rate of change between the inboard point and the intermediate inflection part is less than the rate of change between the intermediate inflection part and the reflex point, and the rate of change between the intermediate inflection part and the reflex point is less than the rate of change between the reflex point and the outboard end.

3. The air-sending device of claim 1, wherein in the projection view, when a length between the reflex point and the outboard end in the direction perpendicular to the rotational axis is defined as a reflex width, and a length between the inboard point and the outboard end in the direction perpendicular to the rotational axis is defined as a blade width, the reflex width is less than or equal to 10% of the blade width.

4. The air-sending device of claim 1, wherein in the projection view, when a length between the reflex point and the outboard end in the direction of the rotational axis is defined as a reflex height, and a length between the inboard point and the outboard end in the direction perpendicular to the rotational axis is defined as a blade width, the reflex height is less than or equal to 10% of the blade width.

5. The air-sending device of claim 1, wherein in the projection view, when a length between the reflex point and the outboard end in the direction of the rotational axis is defined as a reflex height, each of the plurality of blades has a location at which the reflex height has a maximum value, the location being within an area where the position ratio is less than 1.

6. The air-sending device of claim 1, wherein in the projection view, when a length between the reflex point and the outboard end in the direction of the rotational axis is defined as a reflex height, each of the plurality of blades has a location at which the reflex height has a maximum value, the location being within an area where the position ratio is greater than 1 and being not at the trailing edge.

7. The air-sending device of claim 1, wherein in the projection view, when a length between the reflex point and the outboard end in the direction of the rotational axis is defined as a reflex height, each of the plurality of blades has, between the leading edge and the trailing edge, a plurality of locations at each of which the reflex height has an extremal value.

* * * * *